US007192122B2

(12) United States Patent
Tsuruma

(10) Patent No.: US 7,192,122 B2
(45) Date of Patent: Mar. 20, 2007

(54) LIQUID EJECTING HEAD AND A PROCESS FOR PRODUCING THE HEAD

(75) Inventor: Isao Tsuruma, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 248 days.

(21) Appl. No.: 10/950,820

(22) Filed: Sep. 28, 2004

(65) Prior Publication Data

US 2005/0068372 A1 Mar. 31, 2005

(30) Foreign Application Priority Data

Sep. 29, 2003 (JP) ..... 2003-337138

(51) Int. Cl.
*B41J 2/06* (2006.01)

(52) U.S. Cl. ..... 347/55; 347/46

(58) Field of Classification Search ..... 347/20, 347/44, 45, 46, 47, 54, 55, 63, 65, 67
See application file for complete search history.

(56) References Cited

U.S. PATENT DOCUMENTS 6,119,342 A * 9/2000 Shima et al. ..... 347/55

FOREIGN PATENT DOCUMENTS

JP 9-254372 A 9/1997
JP 10-67114 A 3/1998

* cited by examiner

*Primary Examiner*—Juanita D. Stephens
(74) *Attorney, Agent, or Firm*—Sughrue Mion, PLLC

(57) ABSTRACT

A liquid ejecting head of the invention has ink ejected with the electrostatic force, with a structure having a partition wall separating the flow channel into an inflow region and an outflow region. The wall passing by the positions of the ejecting orifices runs in a serpentine path to traverse the ink flow space in a direction perpendicular to the direction of the ink flow. The partition wall is produced by, first, applying a specified film thickness of photoresist on a substrate, second pressing a molding substrate onto a surface of the applied film of the photoresist to form a ridge-like projections which is to be a projecting solution guides, third forming the wall by etching the patterned photoresist film using a mask having a pattern of lines.

9 Claims, 8 Drawing Sheets

LIQUID EJECTING HEAD AND A PROCESS FOR PRODUCING THE HEAD

BACKGROUND OF THE INVENTION

This invention relates to an electrostatic liquid ejecting head with which a solution having charged particles dispersed therein is caused to fly by electrostatic force and deposited on a recording medium to form image. The invention also relates to a process for producing the head.

Various types of ink-jet printing apparatuses have been developed today and they include 1) a thermal type in which ink is heated with a heat-generating resistive element to form a bubble momentarily and the ink is ejected under the pressure of the bubble and 2) a piezoelectric type in which a piezoelectric device is used to convert an electric signal to mechanical vibration that generates a pressure pulse to eject ink. However, the conventional approaches have their own problems; for example, in the thermal type, ink is heated to at least 300° C. and only limited ink materials can be used; in the piezoelectric type, a head structure is necessarily complex which results increasing the equipment cost.

Either type of ink-jet recording apparatus uses ink nozzles and if their size is reduced with a view to increasing the resolution, the solvent evaporates or volatilizes to cause local concentration of the ink, increasing the chance of ink clogging. As a further problem, the conventional nozzle-using ink-jet recording apparatuses are not suitable for improving resolution since ink droplets smaller than 20 micrometer in a diameter are difficult to form.

To form a high-resolution image from an ink-jet recording apparatus, it has been proposed that image be formed by causing ink to fly under electrostatic force. This method requires no nozzles, so one can avoid the problems with ink clogging. What is more, the charged particulate component is condensed at the tip of the head, so ink droplets having very small diameter can be allowed to fly consistently.

However, even in this method, ink will stick to the tip of the head if it is left underrating for a prolonged period. A further problem occurs when ink is ejected continuously; ink supply is not fast enough to prevent the occurrence of fluctuation in the size of ink droplets or considerable drop in the recording frequency.

Techniques that can solve the aforementioned problems have been proposed in JP 9-254372A and JP 10-67114A.

JP 9-254372A relates to an image forming apparatus, such as ink-jet printer, of an electrostatic type. The recording head of the ink-jet printer disclosed in JP 9-254372A and shown in FIG. 14 thereof has a pair of support substrate members laminated each other, each having a plurality of grooves formed on a surface to form ink supply passages and a guide film that is sandwiched between the support substrate members and which has a plurality of projections arranged side by side along the front edge. The individual projections each having a sharp tip are located at openings of the ink supply passages that are formed by the grooves when the pair of support substrate members are laminated together and projections protrude from the openings respectively. A partition wall is provided between adjacent openings such that the wall protrudes from the openings and an ink recovery groove is formed between adjacent partition walls such that the groove extends from the edge of the opening toward the outer peripheral surface of each support substrate member.

According to JP 9-254372A, the carrier fluid separated from a toner particle is pulled up by the capillary action of the ink recovery groove to maintain a stable ink meniscus.

JP 10-67114A relates to an electrostatic printer head, a printer using the head and a method of producing electrodes for use on the head. The method of producing electrodes for use on the printer head as disclosed in JP 10-67114A may be referenced to FIG. 4 thereof. The method comprises the steps of providing a plurality of recesses of different depths in a first substrate by etching, forming an etch stop layer on the surface of the substrate which includes the recesses, forming an electrode layer over the etch stop layer as it fills the recesses over which the etch stop layer has been provided, joining a second substrate in the form of a structural substrate such that the electrode layer is sandwiched between the first substrate and the second substrate, etching away the first substrate, removing the etch stop layer to form bare projecting electrodes, and performing etching to form a groove around each projecting electrode.

According to JP 10-67114A, in order to fabricate the ink-jet printer head, a thermally oxidized insulating $SiO_2$ layer is first formed on the single-crystal Si substrate having the recesses provided by anisotropic etching and the recesses are then filled with a printer head material. Therefore, by controlling the shape of the recesses, one can fabricate a printer head having improved uniformity and reproducing performance.

However, the structure of the recording head on the ink-jet printer disclosed in JP 9-254372A is complex and needs to have a one-dimensional array. Even if two one-dimensional arrays are superposed to form a two-dimensional array, the precision in the positions of the two arrays being superposed will affect the precision of the recording position; this renders the fabrication process difficult to control and increases the fabrication cost.

On the other hand, the recording head fabrication method disclosed in JP 10-67114A can produce a two-dimensional array structure with good precision since it applies the ordinary semiconductor microfabrication technology. However, the method itself is complex enough to increase the manufacturing cost.

SUMMARY OF THE INVENTION

The present invention has been accomplished with a view to solving the aforementioned problems of the prior art. One object of the invention is to provide a liquid ejecting head of a two-dimensional array structure that has high enough positional precision between ink guides to enable consistent recording.

Another object of the invention is to provide a process for producing the liquid ejecting head in high yield with good precision.

The present invention provides a liquid ejecting head which causes electrostatic force to act on a solution containing charged particles such that droplets of the solution are forced out through a two-dimensional array of ejecting portions. The liquid ejecting head has:

a first insulating substrate having ejecting orifices opened in positions corresponding to the layout of the ejecting portions such that the solution is forced out through the ejecting orifices;

a second insulating substrate that is provided a specified distance from the first substrate so as to form a space between the first substrate and the second substrate which constitutes a flow channel for the solution;

electrodes for controlling the ejection of the solution which are provided on the surface of the first substrate which is remote from the second substrate in such positions that each electrode surrounds the periphery of the associated ejecting orifice;

a wall that is erected in the space to partition the flow channel in the space into an inflow region and an outflow region, the wall running in a serpentine path through the space to traverse the space in a direction perpendicular to the direction of the flow of the solution, and the wall passing by the positions of the ejecting orifices provided in the first substrate; and projecting solution guides that are erected on the ridge portion of the wall in positions corresponding to the positions of the ejecting orifices provided in the first substrate, the solution guides extending through the ejecting orifices to protrude from the surface of the first substrate which is remote from the second substrate; and wherein the solution flowing through the space passes through the ejecting orifices to be supplied to the solution guides.

The ejecting portions in the liquid ejecting head are preferably formed such that a plurality of them are aligned in a row along the flow of the solution and two or more of rows are arranged side by side to form a two-dimensional array, and the wall forms wall surfaces along the flow of the solution such that the wall passes through each row of the ejecting portions.

In the liquid ejecting head, preferably a solution guide groove for guiding the solution from the inflow region of the space to the outflow region is formed on the ridge portion of the wall on both sides of each of the solution guides.

The wall surface of each curved portion of the wall running in a serpentine path may have a channel hole opened so that part of the solution is allowed to flow from the inflow region to the outflow region.

The first substrate and the ridge portion of the wall may be spaced apart by a specified distance.

The present invention also provides a liquid ejecting head which causes electrostatic force to act on a solution containing charged particles such that droplets of the solution are forced out through a two-dimensional array of ejecting portions, comprising:

a first insulating substrate having ejecting orifices opened in positions corresponding to the layout of the ejecting portions such that the solution is forced out through the ejecting orifices;

a second insulating substrate that is provided a specified distance from the first substrate so as to form a space between the first substrate and the second substrate which constitutes a flow channel for the solution;

electrodes for controlling the ejection of the solution which are provided on the surface of the first substrate which is remote from the second substrate in such positions that each electrode surrounds the periphery of the associated ejecting orifice;

a plurality of walls that are erected in the space and which run in a serpentine path in a flow direction of the solution from an inflow region to an outflow region, each of the walls being so formed as to pass through the positions of the ejecting orifices provided in the first substrate; and projecting solution guides that are erected on the ridge portion of each of the walls in positions corresponding to the positions of the ejecting orifices provided in the first substrate, the solution guides extending through the ejecting orifices to protrude from the surface of the first substrate which is remote from the second substrate; and wherein the solution flowing through the space passes through the ejecting orifices to be supplied to the tips of the solution guides.

The ejecting portions in the liquid ejecting head are preferably formed such that a plurality of them are aligned in a row along the flow of the solution and two or more of rows are arranged side by side to form a two-dimensional array, and the solution guides are provided on the ridge portion of the curvature of each wall running in the serpentine path.

In The liquid ejecting head, a solution guide groove for guiding the solution from the inflow side of the space to the outflow side is preferably formed on the ridge portion of each of the walls on both sides of each of the solution guides.

In The liquid ejecting head, the first substrate and the ridge portion of each of the walls may be spaced apart by a specified distance.

The present invention also provides a process for producing a liquid ejecting head which causes electrostatic force to act on a solution containing charged particles such that droplets of the solution are forced out through a two-dimensional array of ejecting portions, the liquid ejecting head comprising:

a first insulating substrate having ejecting orifices opened in positions corresponding to the layout of the ejecting portions such that the solution is forced out through the ejecting orifices;

a second insulating substrate that is provided a specified distance from the first substrate so as to form a space between the first substrate and the second substrate which constitutes a flow channel for the solution;

electrodes for controlling the ejection of the solution which are provided on the surface of the first substrate which is remote from the second substrate in such positions that each electrode surrounds the periphery of the associated ejecting orifice;

a wall that is erected in the space to partition the flow channel in the space into an inflow region and an outflow region, the wall running in a serpentine path through the space to traverse the space in a direction perpendicular to the direction of the flow of the solution, and the wall passing through the positions of the ejecting orifices provided in the first substrate; and projecting solution guides that are erected on the ridge portion of the wall in positions corresponding to the positions of the ejecting orifices provided in the first substrate, the solution guides extending through the ejecting orifices to protrude from the surface of the first substrate which is remote from the second substrate. The process has the steps of:

applying a specified film thickness of photoresist to one surface of a substrate which is to be the second substrate;

pressing a molding substrate onto a surface of the applied film of the photoresist, whereby a pattern in which a plurality of ridge-like projections extending in a specified direction are arranged side by side is formed on the surface of the photoresist film; and forming the wall as erected on a surface of the second substrate by etching the patterned photoresist film using a mask having a pattern of lines that extend in a direction different from the extension of the ridge-like projections and which are arranged side by side. 11. The process for producing a liquid ejecting head according to claim 10, wherein etching is performed to form the wall by applying light to the photoresist from the surface on the side where the pattern is formed.

In the process, it is preferable that the second substrate is a transparent substrate and, before the photoresist is applied to one surface of the transparent substrate, a mask having a pattern of lines that extend in a specified direction and which are arranged side by side is formed on the transparent surface and, using the mask, etching is performed to form the wall by applying light to the photoresist from an opposite surface to the one surface of the transparent substrate by means of using transparency of the transparent substrate.

The present invention also provides a process for producing a liquid ejecting head which causes electrostatic force to act on a solution containing charged particles such that droplets of the solution are forced out through a two-dimensional array of ejecting portions, the liquid ejecting head comprising:

a first insulating substrate having ejecting orifices opened in positions associated with the layout of the ejecting portions such that the solution is forced out through the ejecting orifices;

a second insulating substrate that is provided a specified distance from the first substrate so as to form a space between the first substrate and the second substrate which constitutes a flow channel for the solution;

electrodes for controlling the ejection of the solution which are provided on the surface of the first substrate which is remote from the second substrate in such positions that each electrode surrounds the periphery of the associated ejecting orifice;

a plurality of walls that are erected in the space and which run in a serpentine path in the flow direction of the solution from an inflow region to an outflow region, each of the walls being so formed as to pass through the positions of the ejecting orifices provided in the first substrate; and projecting solution guides that are erected on the ridge portion of each of the walls in positions corresponding to the positions of the ejecting orifices provided in the first substrate, the solution guides extending through the ejecting orifices to protrude from the surface of the first substrate which is remote from the second substrate. The process has the steps of:

applying a specified film thickness of photoresist to one surface of the second substrate which is to be the second substrate;

pressing a molding substrate onto a surface of the applied film of the photoresist, whereby a pattern in which ridge-like projections extending in a specified direction are arranged side by side is formed on the surface of the photoresist film; and forming the plurality of walls as erected on a surface of the second substrate by etching the patterned photoresist film using a mask having a pattern of lines that extend in a direction different from the extension of the ridge-like projections and which are arranged side by side.

In the process for producing a liquid ejecting head, etching is preferably performed to form the walls by applying light to the photoresist from the surface on the side where the pattern is formed.

In the process for producing a liquid ejecting head, it is alternatively preferable that the second substrate is a transparent substrate and, before the photoresist is applied to one surface of the transparent substrate, a mask having a pattern of lines that extend in a specified direction and which are arranged side by side is formed on the one surface of the transparent substrate and, using the mask, etching is performed to form the wall by applying light to the photoresist from an opposite surface to the one surface of the transparent substrate by means of using transparency of the transparent substrate.

The present invention also provides a process for producing a liquid ejecting head which causes electrostatic force to act on a solution containing charged particles such that droplets of the solution are forced out through a two-dimensional array of ejecting portions, the liquid ejecting head comprising:

a first insulating substrate having ejecting orifices opened in positions corresponding to the layout of the ejecting portions such that the solution is forced out through the ejecting orifices;

a second insulating substrate that is provided a specified distance from the first substrate so as to form a space between the first substrate and the second substrate which constitutes a flow channel for the solution;

electrodes for controlling the ejection of the solution which are provided on the surface of the first substrate which is remote from the second substrate in such positions that each electrode surrounds the periphery of the associated ejecting orifice;

a wall that is erected in the space to partition the flow channel in the space into an inflow region and an outflow region, the wall running in a serpentine path through the space to traverse the space in a direction perpendicular to the direction of the flow of the solution, and the wall passing through the positions of the ejecting orifices provided in the first substrate; and projecting solution guides that are erected on the ridge portion of the wall in positions corresponding to the positions of the ejecting orifices provided in the first substrate, the solution guides extending through the ejecting orifices to protrude from the surface of the first substrate which is remote from the second substrate. The process has the steps of:

joining a single-crystal substrate onto one surface of a third substrate and, in a plurality of positions on a surface of the single-crystal substrate where the ejecting portions are to be formed, performing anisotropic etching using a first mask on which pattern features of a predetermined shape are arranged two-dimensionally in two orthogonal directions, whereby projections that serve as the solution guides are formed two-dimensionally on the one surface of the third substrate; and etching the side of the third substrate where the projections are formed by a specified amount such that not all of the third substrate is removed, the etching performed using a mask on which a plurality of lines that extend in one direction of the two directions side by side, whereby the wall is formed and the remaining part of the third substrate is used as the second substrate.

In the process for producing a liquid ejecting head, the step of etching the third substrate is preferably preceded by a step of performing etching using a mask on which another plurality of lines that extend in the other direction of the two directions are arranged side by side, whereby grooves that serve to guide the solution from the inflow region of the space to the outflow region is formed on both sides of each of the projections.

The present invention also provides a process for producing a liquid ejecting head which causes electrostatic force to act on a solution containing charged particles such that droplets of the solution are forced out through a two-dimensional array of ejecting portions, the liquid ejecting head comprising:

a first insulating substrate having ejecting orifices opened in positions corresponding to the layout of the ejecting portions such that the solution is forced out through the ejecting orifices;

a second insulating substrate that is provided a specified distance from the first substrate so as to form a space between the first substrate and the second substrate which constitutes a flow channel for the solution;

electrodes for controlling the ejection of the solution which are provided on the surface of the first substrate which is remote from the second substrate in such positions that each electrode surrounds the periphery of the associated ejecting orifice;

a plurality of walls that are erected in the space and which run in a serpentine path in the flow direction of the solution from an inflow region to an outflow region, each of the walls being so formed as to pass through the positions of the ejecting orifices provided in the first substrate; and projecting solution guides that are erected on the ridge portion of each of the walls in positions corresponding to the positions of the ejecting orifices provided in the first substrate, the solution guides extending through the ejecting orifices to protrude from the surface of the first substrate which is remote from the second substrate. The process has the steps of:

joining a single-crystal substrate onto one surface of a third substrate and, in a plurality of positions on a surface of the single-crystal substrate where the ejecting portions are to be formed, performing anisotropic etching using a first mask on which pattern features of a predetermined shape are arranged two-dimensionally in two orthogonal directions, whereby projections that serve as the solution guides are formed two-dimensionally on the one surface of the third substrate; and etching the side of the third substrate where the projections are formed by a specified amount such that not all of the third substrate is removed, the etching performed using a mask on which a plurality of lines that extend in one direction of the two directions are arranged side by side, whereby the walls are formed and the remaining part of the third substrate is used as the second substrate.

In the process for producing a liquid ejecting head, the step of etching the third substrate is preferably preceded by a step of performing etching using a mask on which another plurality of lines that extend in the other direction of the two directions are arranged side by side, whereby grooves that serve to guide the solution from the inflow region of the space to the outflow region is formed on both sides of each of the projections.

According to the invention, the channel of a solution is separated by a wall into an inflow region and an outflow region, with the solution passing by ejection orifices where solution guides are provided when ink moves from the inflow side to the outflow side, whereby ink can be efficiently supplied to solution guides.

In addition, according to the invention, the wall is configured to run in a serpentine path, traversing the ink flow, whereby the solution can be supplied to the solution guides without getting stagnant.

Further according to the invention, the wall supports the second substrate, whereby it becomes possible to reduce the effects of the warpage of the second substrate during manufacture and of its deformation under the pressure of the solution.

Further in addition, according to the invention, a liquid ejecting head can be produced by the above-described process in high yield with good precision and at lower cost.

This application claims priority on Japanese patent application No.2003-337138, the entire contents of which are hereby incorporated by reference.

BEST MODES FOR CARRYING OUT THE INVENTION

On the following pages, the liquid ejecting head of the invention and the process for producing it are described in detail with reference to the accompanying drawings.

Figure 1A:
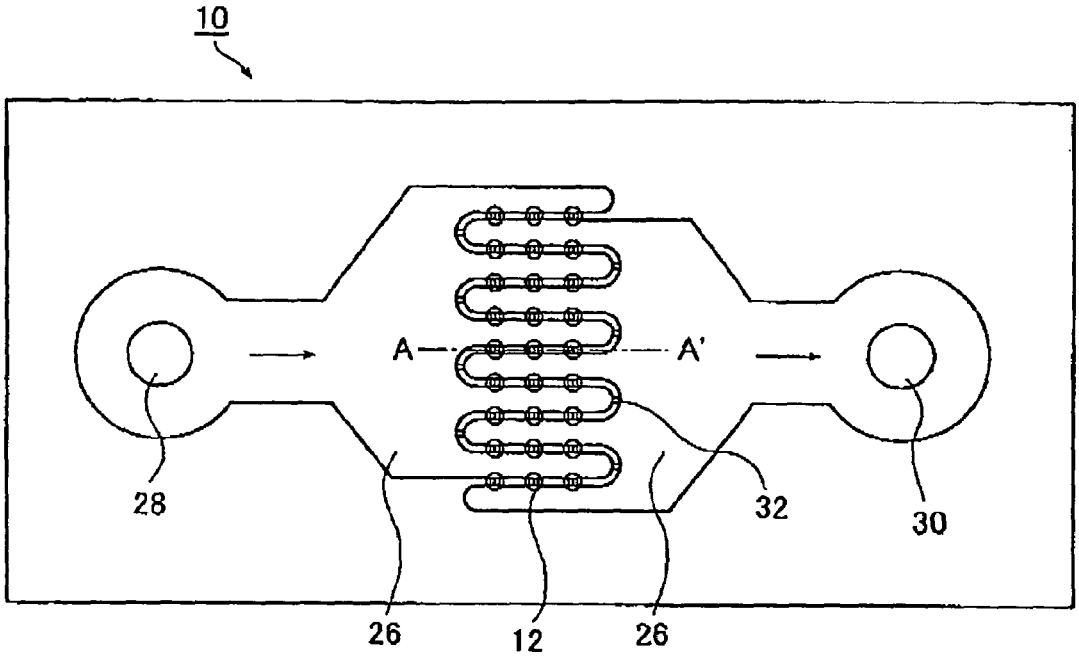
FIG. 1A shows schematically the upper surface of an ink-jet head which is an example of the liquid ejecting head of the invention.
Figure 1B:
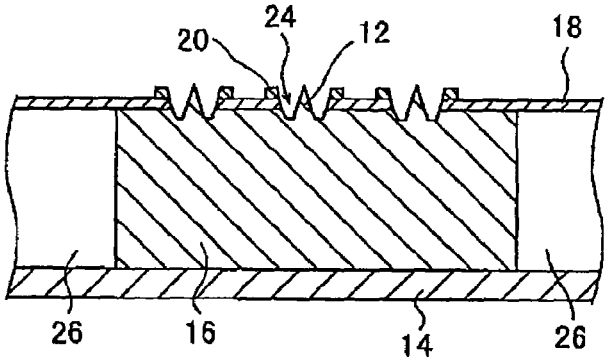
FIG. 1B is a schematic section A–A' of FIG. 1A.

FIG. 1A shows schematically the upper surface of an ink-jet head which is an example of the liquid ejecting head of the invention and FIG. 1B is a schematic section A–A' of FIG. 1A.

The ink-jet head shown in FIG. 1A by 10 has 27 (3×9) ejecting portions in a two-dimensional array and comprises ink guides 12, a head substrate 14, a partition wall 16, a control substrate 18, ejection electrodes 20, etc. Note that the number and layout of the ejecting portions are not limited in any particular way.

As shown in FIG. 1A, the head substrate 14 has an ink inflow opening 28 made on the left side region(the ink inflow side region) and an ink outflow opening 30 made on the right side region (the ink outflow side region). The ink inflow opening 28 and the ink outflow opening 30 are connected to an ink circulating device (not shown) from the side of the paper which is away from the viewer; during image recording, the ink circulating device supplies ink through the ink inflow opening 28 and the excess ink which has not been used in the recording is recovered through the ink outflow opening 30.

The partition wall 16 is erected on the head substrate 14 at a generally central area in the illustrated case. The partition wall 16 has straight portions and curved portions. The straight portions of the partition wall 16 pass through the positions corresponding to the layout of the ejecting portions such that the wall separates the ink inflow region of the substrate 14 (where the ink inflow opening 28 is provided) from the ink outflow region (where the ink outflow opening 30 is provided); at the same time, the partition wall 16 traverses the ink flow directed from the ink inflow opening 28 to the ink outflow opening 30 while the wall runs in a serpentine shape. By means of the partition wall 16, the ink inflow side and the ink outflow side alternate in the space where an ink channel is provided and, as the result, the ink supplied through the ink inflow opening 28 is accelerated to a specified flow rate.

On the top (ridge) of the straight portions of the partition wall 16, ink guides 12 are erected in the positions corresponding to the layout of the ejecting portions. As shown in FIG. 1B, the ink guides 12 are of an inverted V shape with a sharp pointed tip and an ink guide groove 24 for guiding ink from the ink inflow region to the outflow region is formed on both sides of each ink guide 12 on the ridge surface of the partition wall 16. Note that the shapes, sizes and other features of the ink guides 12 and the ink guide grooves 24 are not limited in any particular way and may be determined as appropriate for a specific need.

The control substrate 18 has ink ejecting orifices 22 opened in the positions corresponding to the layout of the ejecting portions and ejection electrodes 20 which control ink ejection are provided on top of the control substrate 18 in such positions that each electrode surrounds the periphery of the associated ejecting orifice 22. The control substrate 18 is provided on top of the partition wall 16 such that the individual ink guides 12 pass inside the corresponding ejection orifices 22 and the space between the head substrate 14 and the control substrate 18 provides an ink channel 26. The height of the ink guides 12 is such that their pointed tip protrudes beyond the surface of the ejection electrodes 20.

Preferably, the control substrate 18 contacts the surface of the partition wall 16 such that it is supported by the latter. However, if desired, the two members may be spaced apart by a certain distance such that no more than a certain volume of ink will pass through the gap.

Figure 2:
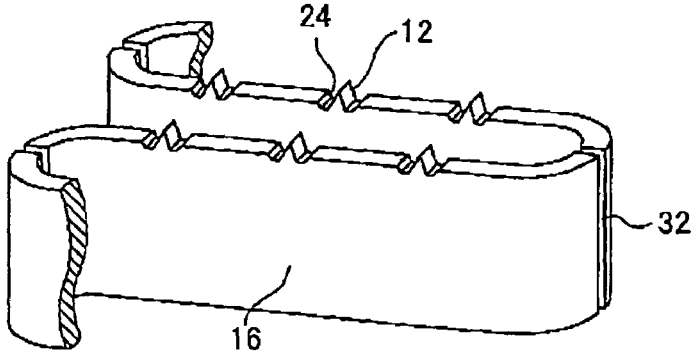
FIG. 2 is a perspective view showing primarily the partition wall and the nearby area of the liquid ejecting head shown in FIG. 1.

As shown in FIG. 2, the partition wall 16 may have an ink channel hole 32 opened as a slit in the sidewalls of the curved portions located at either side of the ink inflow region (the left side of FIG. 1A) or the ink outflow region (the right side of FIG. 1A) or both. The ink channel hole 32 is preferably formed to run substantially parallel to the ink flow direction from the inflow to the outflow side.

The operation of the foregoing apparatus is described below in detail.

To form an image on a recording medium by means of the ink-jet head 10, ink which contains a coloring component charged to the same polarity as the polarity of the voltage to be applied to the ejection electrodes 20 is supplied through the ink inflow opening 28 by the ink circulating device not shown. The ink supplied through the ink inflow opening 28 passes through the ink guide groove 24 formed on both sides of each of the ink guides 12 on the top surface of the partition wall 16 and flows to the ink outflow region where it is recovered through the ink outflow opening 30. In this case, a portion of the ink flowing through the ink guide grooves 24 passes by the ejection orifices opened in the control substrate 18 and runs along each ink guide 12 to be supplied to its tip.

The flow rate of the ink is sufficiently accelerated by the partition wall 16 that it is kept supplied consistently to the tip of each ink guide 12. If ink channel holes are provided in the partition wall, the volume of the ink that is supplied to the ejection orifices can be optimized without taking the risk of excessive supply.

When the ejection electrodes are off, the flowing energy of the ink and the capillary force developing at the ejection orifices 22 will cause the ink to ascend toward the tip of each ink guide 12 protruding beyond the surface of the associated ejection electrode 20, whereby a specified meniscus is formed.

Given this state, the ejection electrodes 20 are supplied with a specified voltage in accordance with input image data, whereupon the ink at the tip of each ink guide 12 is ejected as a droplet by the electrostatic force acting on the charged coloring component. The ejected ink droplets are attracted by counter electrodes (not shown) that are arranged in positions opposite the ejecting portions and which are biased to a voltage level of opposite polarity with respect to the ink, whereupon the droplets reach a targeted recording medium (not shown) placed over the counter electrodes.

The ink-jet head 10 operating in this way and the recording medium placed over the counter electrodes are moved relative to each other such that a desired image is formed on the recording medium.

The ink-jet head according to the first embodiment is configured such that the ink channel is separated by the partition wall into the inflow region and the outflow region and that those two regions are arranged to alternate with each other along the perpendicular direction to the ink flow; as a result, the ink flow rate is sufficiently accelerated to ensure that the ink is supplied to the tip of each ink guide with high efficiency. In addition, since the control substrate is supported by the partition wall, it becomes possible to reduce the effects of the warpage of the control substrate during manufacture and of its deformation under the pressure of the solution.

We next describe a second embodiment of the liquid ejecting head of the invention.

Figure 3A:
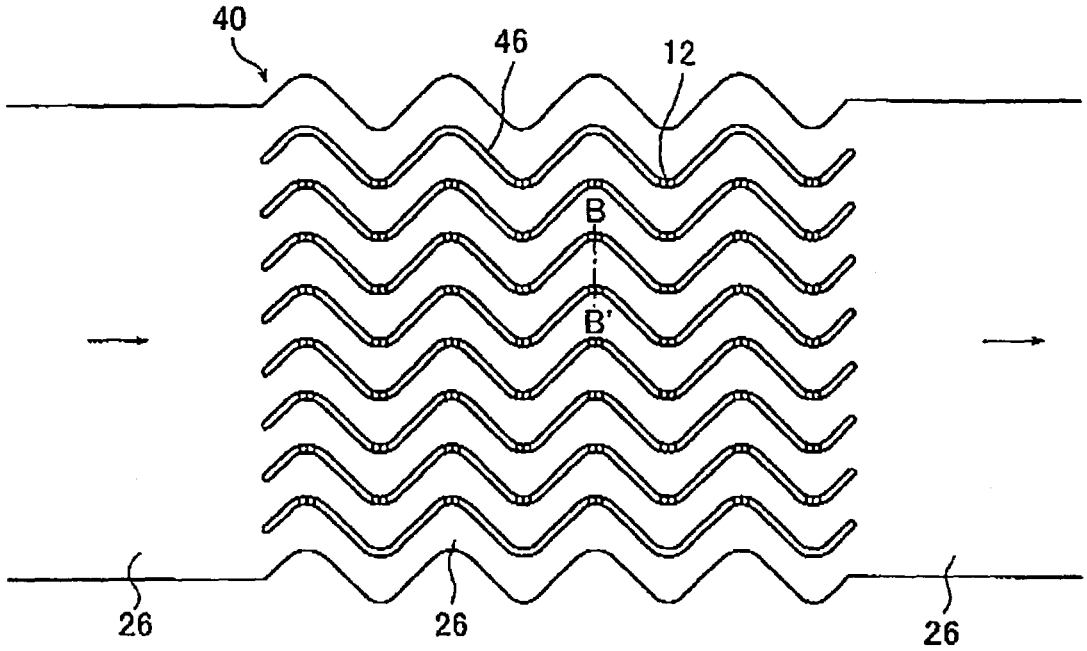
FIG. 3A shows schematically the upper surface of an ink-jet head which is another example of the liquid ejecting head of the invention.
Figure 3B:
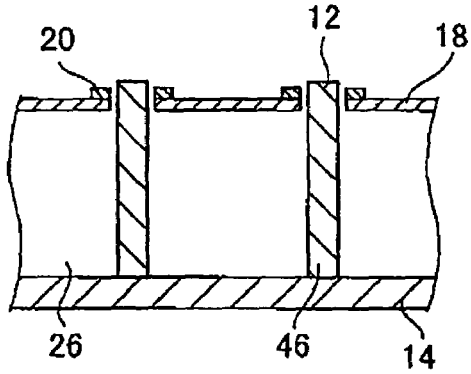
FIG. 3B is a schematic section B–B' of FIG. 3A.

FIG. 3A shows schematically the upper surface of an ink-jet head according to the second embodiment of the liquid ejecting head of the invention and FIG. 3B is a schematic section B–B' of FIG. 3A. The ink-jet head shown in FIG. 3A by 40 has 56 (8×7) ejecting portions in a two-dimensional array. Since the only difference between the ink-jet head 40 shown in FIG. 3A and the ink-jet head 10 shown in FIG. 1A relates to the structure of the partition wall, the same constituents are identified by like numerals and a detailed explanation of the ink-jet head 40 is omitted.

Figure 4:
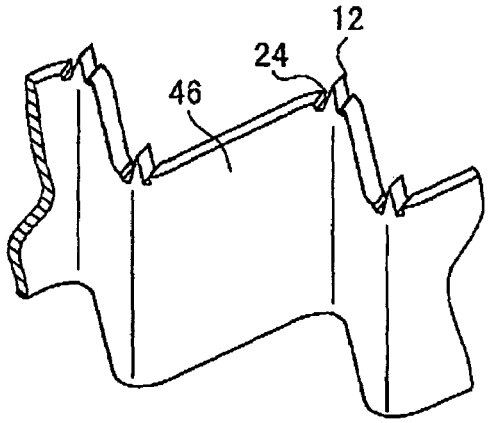
FIG. 4 is a perspective view showing primarily the partition wall and the nearby area of the liquid ejecting head shown in FIG. 3.

The ink-jet head 40 has eight partition walls 46 erected on it. The curved portions of each partition wall 46 pass through the positions corresponding to the layout of the ejecting portions and, at the same time, each partition wall 16 extends in the ink flow direction from the inflow region to the outflow region; the eight partition walls 46 running in a serpentine shape in a direction perpendicular to the ink flow are arranged side by side. To be more specific, as shown in FIG. 4, ink guides 12 are provided on the tops (ridges) of the curved portions of each partition wall 46 at the positions corresponding to the layout of the ejecting portions. The number of the partition walls 46 is determined as appropriate for the layout of the ejecting portions. The shape of the partition walls 46 is not limited to the illustrated sinusoidal waveform and it may be in other shapes including a triangular waveform.

In the ink-jet head 40, the ink flow rate differs between the convex and the concave of each curved portion of the partition wall and this difference, which is determined by the shape of the partition wall, is used for the ink flow, causing the flow from the concave to the convex. As the result, part of the ink passing through the ink guide grooves is efficiently supplied to the tip of the associated ink guide. In the embodiment under consideration, the ink channel 26 is not separated by walls, so it gives the added advantage of causing no ink stagnation and, therefore, in maintenance and other operations, ink replacement and other operations can be performed without any trouble.

In the first and second embodiments, the ejection electrodes 20 are single-layered but they may be composed of more than one layer, for example, two layers and arranged in a controllable matrix. The shape of the ejection electrodes is not limited and any shape may be adopted.

Let us now describe the process for producing the liquid ejecting head of the invention.

First, referring to FIGS. 5A to 5E, we describe a method of fabricating a molding substrate used to make ink guides having sharp pointed tips and associated ink guide grooves.

A single-crystal substrate 62 typically made of Si is provided and, on top of this substrate, Cr or other substance is deposited by sputtering or other technique to form a light-shielding film 30–50 nm thick. On top of the light-shielding film, a resist pattern consisting of lines that extend in a (010) or (001) direction of the single-crystal substrate 62 is formed by convetional photolithographic techniques and using this resist pattern, the light-shielding film is etched to form a mask 64 (see FIG. 5A).

Figure 5A:
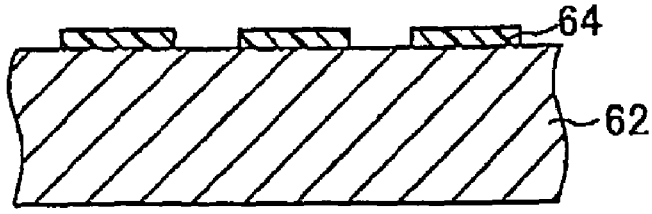
FIG. 5 is a schematic diagram illustrating an embodiment of a method of fabricating a molding substrate which is to be used in a first and a second embodiment of the process for producing the liquid ejecting head of the invention.
Figure 5B:
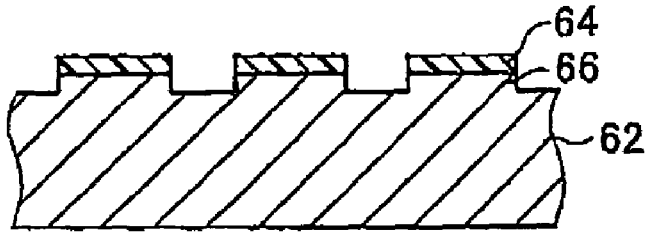

In the next step, using a 30% aqueous KOH solution heated at, say, 70° C., Si is wet etched (anisotropically etched) by a specified amount, whereby a plurality of projections 66 are formed side by side on a surface of the single-crystal substrate 62 (see FIG. 5B).

Figure 5C:
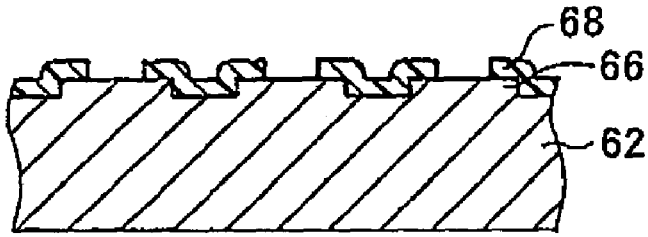
Figure 5D:
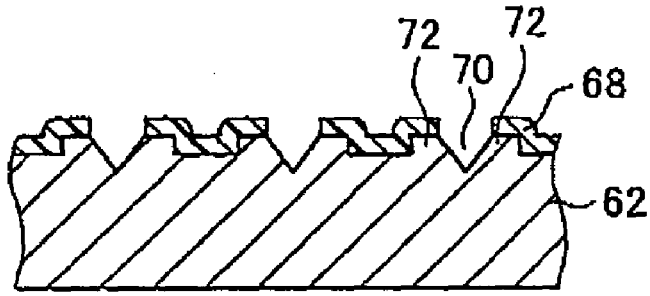

Thereafter, the mask 64 is removed and another light-shielding film is formed in a thickness of 30–50 nm on the single-crystal substrate 62 by etching or other technique and photolithography is performed by the same techniques as described above to form a mask 68 in which the central portion of each projection 66 is bare in the direction it extends (see FIG. 5C).

Figure 5E:
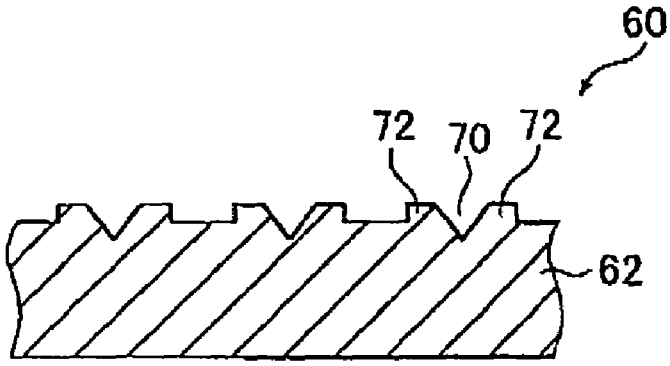

Then, the single-crystal substrate 62 is anisotropically etched to form V-shaped grooves 70 (see FIG. 5D) and the mask 68 is removed to prepare a molding substrate 60 furnished with the V-shaped grooves 70 for making ink guides having sharp pointed tips and projections 72 for making ink guide grooves (see FIG. 5E).

This is not the sole method of preparing the molding substrate and it can be prepared by any common microfabrication techniques including laser beam machining and microwave EDM. If desired, the molding substrate may be provided with a coating that facilitates its detachment in a subsequent step. Preferably, a target mark for alignment is formed in at least one of the specified positions on a surface of the molding substrate 60 such that the target mark may also be transferred to a light-sensitive resin layer during subsequent shaping with the molding substrate 60.

Referring to FIGS. 6A to 6D, we next describe a method of fabricating the partition wall and ink guides.

Figure 6A:
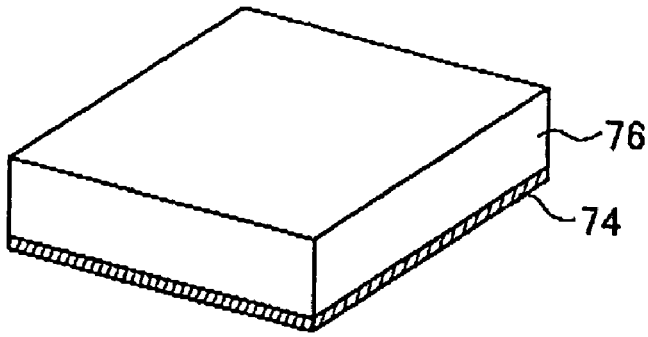
FIG. 6 is a schematic diagram illustrating the first embodiment of the process for producing the liquid ejecting head of the invention.
Figure 6B:
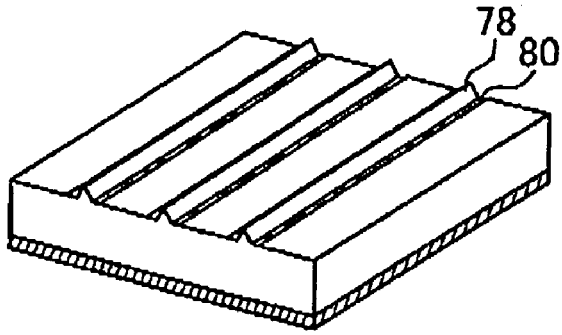

To begin with, through-holes that serve as an ink flow opening and an ink outflow opening are formed in specified positions through an insulating substrate 74 (see FIG. 6A). Through-holes may be formed by commonly known microfabrication techniques including laser beam machining, ultrasonic machining and sandblasting. A surface of the insulating substrate 74 in which the through-holes have been made is spin-coated with a light-sensitive resin material (photoresist) such as NANO SU-8 of MicroChem in a thickness of, say, 200 micrometer to 1 mm to form a light-sensitive resin layer 76. In the embodiment under consideration, the light-sensitive resin material is a negative-working resist whose characteristics are such that, upon exposure to ultraviolet or other radiation, it polymerizes or crosslinks to become slightly soluble in a liquid developer and remains intact on the substrate surface until after development ends.

In the next step, the molding substrate 60 and the insulating substrate 74 are set on a heating press as the surface of the molding substrate 60 where the V-shaped grooves 70 and the projections 72 are formed is opposed to the surface of the insulating substrate 74 which is coated with the light-sensitive resin layer 76. With the assembly being heated to at least 50–60° C. which is the glass transition point of SU-8 and with the gap between the molding substrate 60 and the light-sensitive resin layer 76 being deaerated with a vacuum pump, the molding substrate 60 is pressed onto the light-sensitive resin layer 76 at a pressure of at least, say, 0.1 MPa so that the surface shape of the molding substrate 60 is transferred to the light-sensitive resin layer 76.

In this case, a spacer is preferably provided between the insulating substrate 74 and the molding substrate 60 to control the height of the light-sensitive resin layer 76. If the process atmosphere is evacuated before the molding substrate 60 is pressed onto the light-sensitive resin layer 76, it is possible to prevent the formation of bubble-like defects in the light-sensitive resin layer 76.

In the next step, the whole assembly is cooled to a temperature below the glass transition point of SU-8 and the molding substrate 60 is detached from the light-sensitive resin layer 76. As the result, projections 78 that serve as ink guides having sharp pointed tips and recesses 80 that serve as ink guide grooves are formed on the light-sensitive resin layer 76 (see FIG. 6B). Preferably, the molding substrate 60 as it is pressed onto the surface of the light-sensitive resin layer 76 forms a target mark in at least one area that assists in the alignment to be effected in a subsequent step. After forming the projections 78 and the recesses 80, the light-sensitive resin layer 76 is overlaid with a matching oil layer 82 that has a generally equal refractive index to the light-sensitive resin layer 76.

Figure 6C:
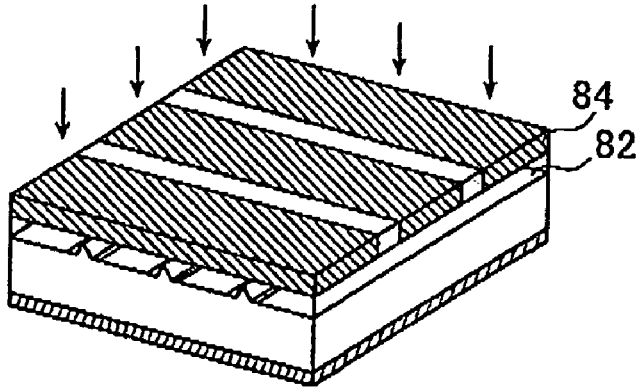
Figure 6D:
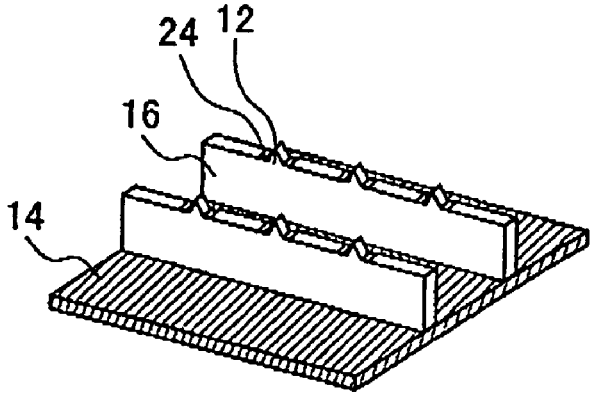
Figure 7:
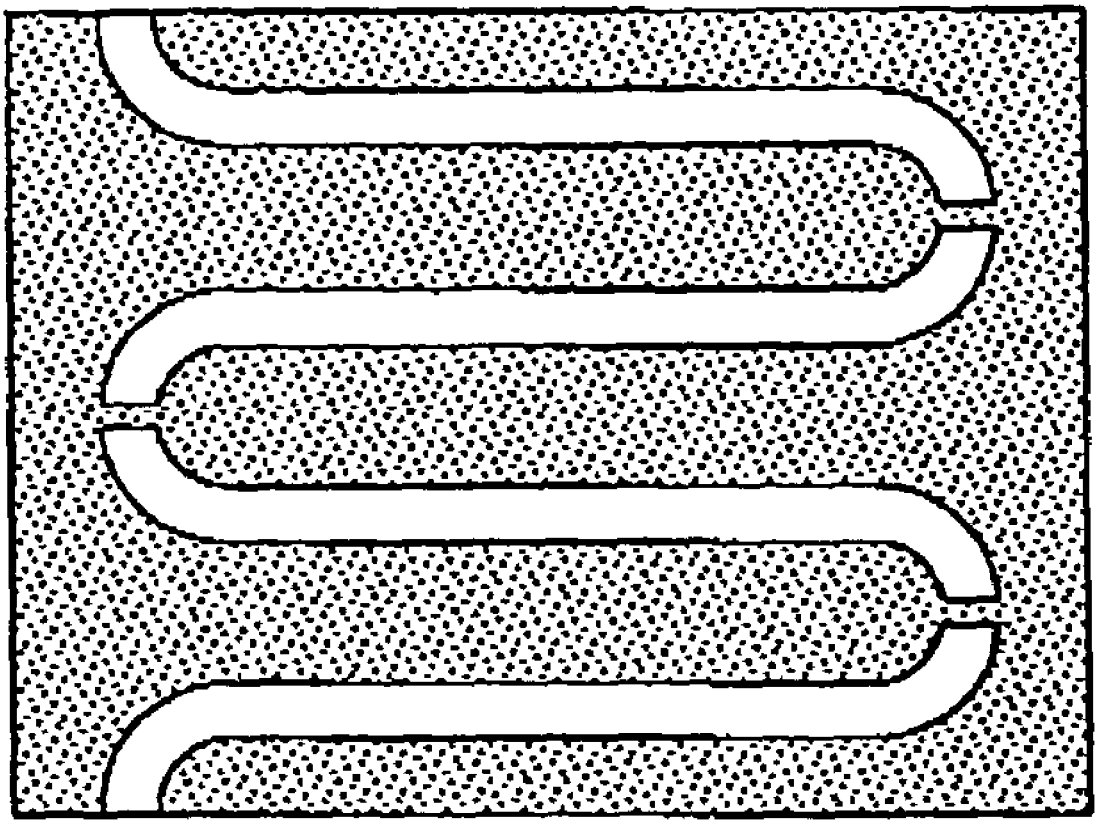
FIG. 7 shows schematically a mask that is used in providing the shape of the partition wall shown in FIG. 1.

Thereafter, a mask 84 which, as shown in FIG. 7, is provided with a pattern for forming the partition wall 16 of the ink-jet head 10 (see FIG. 1) which has the ink channel holes 32 is placed flat on the matching oil layer 82 (see FIG. 6C). Preferably, the target mark for alignment that is formed in a specified position on the mask is brought into registry with the target mark for alignment on the light-sensitive resin layer 76 so that the projections 78 and recesses 80 shaped on the light-sensitive resin layer 76 have a desired positional relationship with the transmissive areas of the mask 84. Then, ultraviolet light at a wavelength of 350–400 nm is applied from the side where the mask 84 is provided, thereby exposing the light-sensitive resin layer 76. The exposing light is preferably parallel light that falls perpendicularly on the insulating substrate 74.

In the next step, the insulating substrate 74 is heated at 50–100° C. to harden the exposed areas of the light-sensitive resin layer 76 and, thereafter, the insulating substrate 74 is cut to a predetermined head size with a dicing saw and the like. Subsequently, the unexposed areas of the light-sensitive resin layer 76 are removed with a liquid developer and the whole assembly is rinsed with pure water to remove the liquid developer. Thereafter, the exposed areas are hardened again, typically at 100–200° C. This results in the fabrication of a head substrate furnished with the partition wall 16 that has a two-dimensional array of ink guides 12 on the top (see FIG. 6D) and which has ink channel holes 32 formed in the sidewalls of the curved portions (see FIG. 2).

Thereafter, the control substrate 18 that has through-holes opened in positions corresponding to the ink guides and which have ejection electrodes 20 (for application of an electric field) formed thereon is placed on top of the head substrate to fabricate an ink-jet head.

In the embodiment under consideration, the light-sensitive resin material is negative-working. Conversely, a positive-working light-sensitive resin material may be employed and this type has such characteristics that, upon illumination with ultraviolet or other exposing light, it becomes soluble in a liquid developer and can be removed from the substrate surface during development. If a positive-working light-sensitive resin material is used, exposure of the light-sensitive resin layer is performed in such a way that those areas which will eventually serve as ink guide members are shielded from light, with the other areas being exposed to light to form a pattern of a desired shape in a desired position.

In the embodiment under consideration, selective exposure of the light-sensitive resin layer is accomplished by a contact exposure technique in which the matching oil layer formed on top of the light-sensitive resin layer is brought into intimate contact with the mask during exposure. This is not the sole method of exposure that can be adopted in the present invention and it may be replaced by a proximity exposure technique in which no matching oil layer is formed on top of the light-sensitive resin layer, which is kept a certain distance from the mask. It should, however, be noted that in order to ensure that the ultraviolet light passing through the mask will not be diffracted at the openings in the pattern but will travel sufficiently straight to make ink guide members having sharp pointed tips of high precision, contact exposure is preferably performed as in the foregoing embodiment using a matching oil. Alternatively, a projection exposure technique may be employed to obviate the use of a mask and a matching oil and yet exposure can be performed to produce a pattern of a predetermined shape in a predetermined position.

Referring to FIGS. 8A–8E, we then describe a second embodiment of the process for fabricating an ink-jet head which is an example of the liquid ejecting head of the invention.

First, a transparent insulating substrate 90 such as a glass substrate is provided (see FIG. 8A) and through-holes as in the first embodiment that serve as an ink inflow opening and an ink outflow opening are formed. A light-shielding film is formed of Cr or the like on the insulating substrate 90 by sputtering or other technique; the film is selectively etched by photolithographic techniques to form a mask 92 on the insulating substrate 90. The mask 92 may have the pattern shown in FIG. 7.

The surface of the insulating substrate 90 on which the mask 92 is formed is spin-coated with a light-sensitive resin material such as NANO SU-8 of MicroChem in a predetermined thickness or more to form a light-sensitive resin layer 76. In the embodiment under consideration, a negative-working resist is used as the light-sensitive resin material.

Thereafter, as in the first embodiment, a molding substrate 60 is used to provide a surface of the light-sensitive resin layer 76 with projections 78 and recesses 80 that serve as ink guides and ink guide grooves, respectively.

Then, ultraviolet light having a wavelength of 350–400 nm is applied to the insulating substrate 90 from the side (from below in FIG. 8C) which is opposite the side where the light-sensitive resin layer 76 is formed. In this way, the light-sensitive resin layer 76 is subjected to a specified amount of exposure.

Figure 8A:
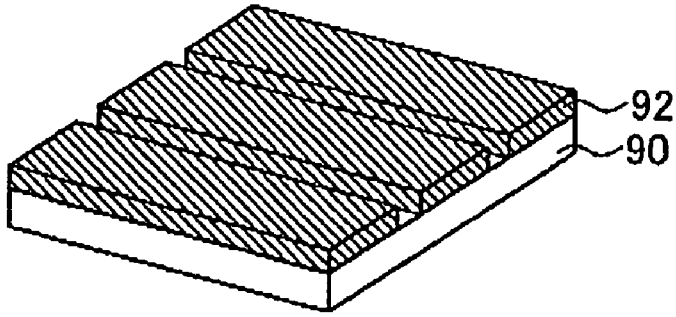
FIG. 8 is a schematic diagram illustrating the second embodiment of the process for producing the liquid ejecting head of the invention.
Figure 8B:
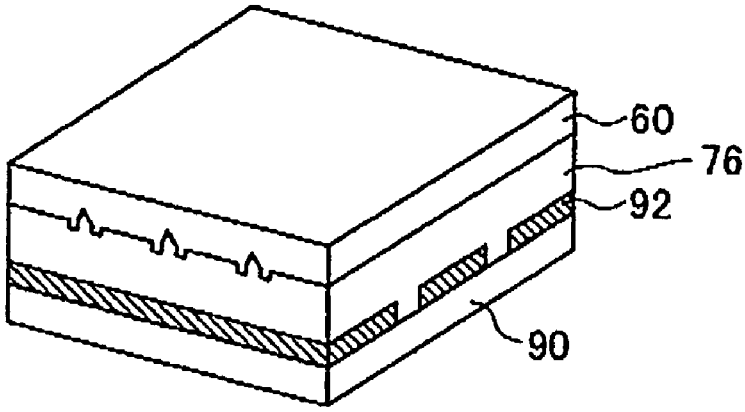
Figure 8C:
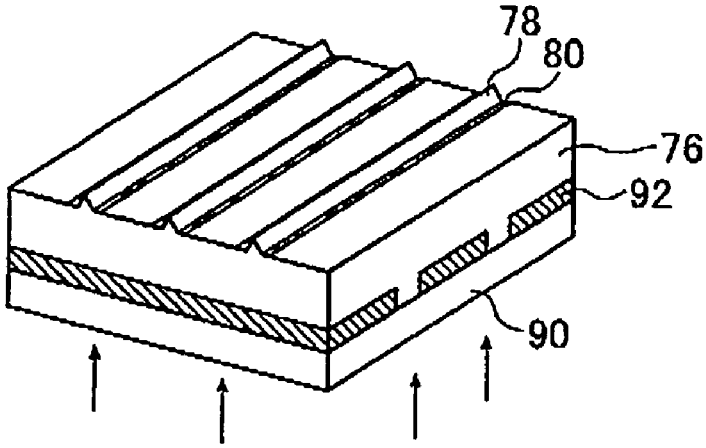
Figure 8D:
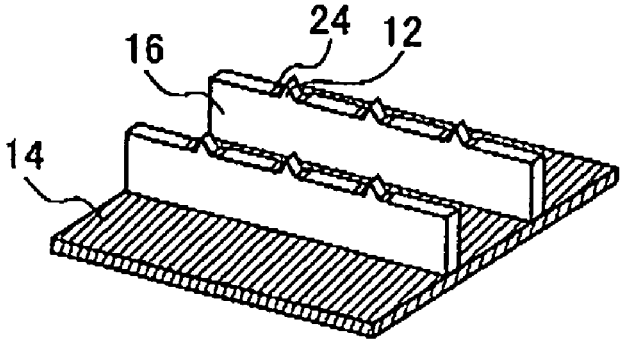

Subsequently, as in the first embodiment, the exposed areas are hardened, the insulating substrate 90 is diced, the exposed areas are developed, rinsed and hardened again, thereby fabricating a head substrate 14 furnished with the partition wall 16 having ink guides 12 formed on the top (see FIG. 8D).

Referring to FIGS. 9A–9F, we then describe a third embodiment of the process for fabricating an ink-jet head which is an example of the liquid ejecting head of the invention. First, a glass substrate 104 (see FIG. 9A) which may be polished on both sides is provided. On top of this glass substrate, Si is joined by, for example, a surface activating technique to form a single-crystal-substrate 106. Subsequently, the single-crystal substrate 106 is overlaid with a $SiO_2$ film by, for example, thermal oxidation and the $SiO_2$ layer is etched by photolithographic techniques in a pattern of squares whose sides extend in the (110) and (1–10) directions of the single-crystal substrate 106; this results in the fabrication of a mask 108 having a two-dimensional array of squares in positions corresponding to the ejecting portions.

In the next step, the assembly is immersed in a hot liquid such as a 34% aqueous KOH solution heated at about 70° C. and the single-crystal substrate 106 is etched anisotropically according to the pattern on the mask 108. By etching the single-crystal substrate 106 until the mask 108 comes off, projections 110 are formed on top of the substrate 104 (see FIG. 9B). The projections 110 which serve as ink guides may be in the shape of a pyramid that has a sharp pointed peak with an angle of no more than about 60 degrees (or a radius of curvature of no more than 4 micrometer).

Figure 9A:
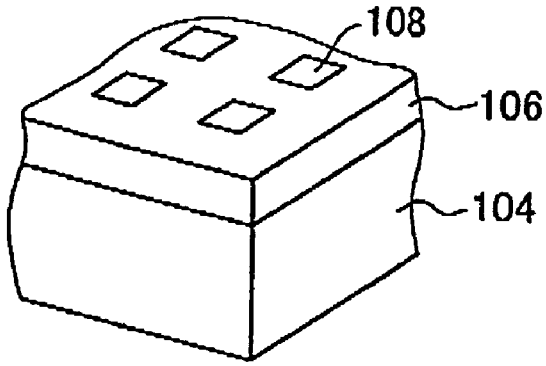
FIG. 9 is a schematic diagram illustrating a third embodiment of the process for producing the liquid ejecting head of the invention.
Figure 9B:
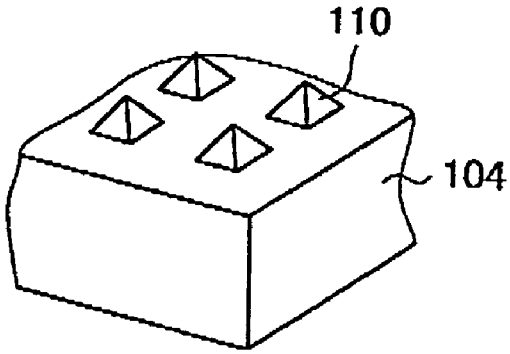
Figure 9C:
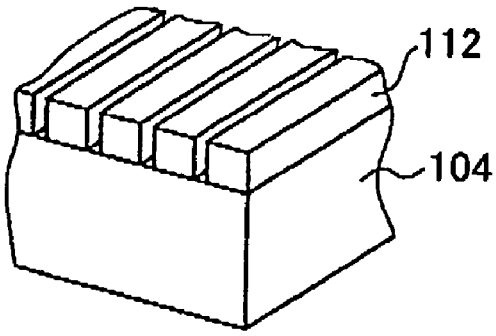
Figure 9D:
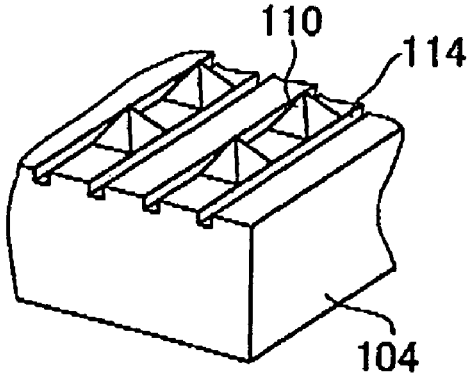

Then, a photoresist is spin-coated or otherwise applied to form a resist layer, which is patterned by photolithographic techniques to form a mask 112 which has a pattern of parallel lines that pass over the projections 110 and which are corresponding to ink guide grooves (see FIG. 9C). By subsequent dry etching, typically using $CF_4$ gas, recesses 114 that serve as ink guide grooves are formed in the substrate 104 and the mask 112 is then removed (see FIG. 9D).

Figure 9E:
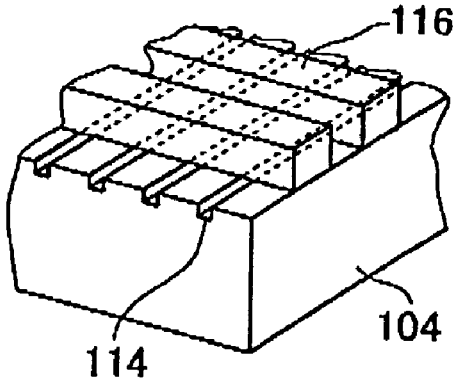

Thereafter, a resist layer is formed again on the substrate 104 and patterned by photolithographic techniques to form a mask 116 which has a pattern of parallel lines that extend in a direction generally perpendicular to the extension of the recesses 114 and which are corresponding to the straight portions of the partition wall, with the projections 110 being interposed (see FIG. 9E).

Figure 9F:
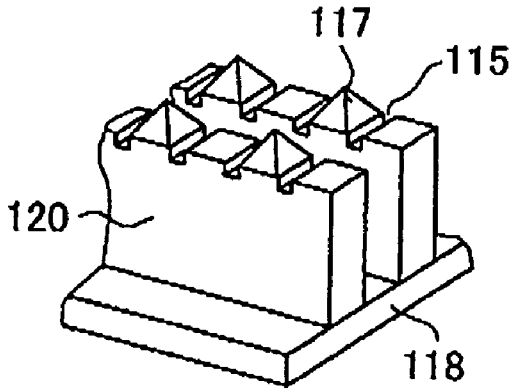

By subsequent dry etching, typically using $CF_4$ gas, a partition wall 120 is formed on top of the substrate 104 (see FIG. 9F). In this case, the top of the substrate 104 is etched by a specified amount, leaving the lower part of the substrate 104 intact as a head substrate. Thereafter, the mask 116 is removed to fabricate a head substrate 118 furnished with the partition wall 120 having sharp pointed ink guides 117 and ink guide grooves 115 formed on the top.

In the embodiment described above, the mask 108 used to form ink guides has a pattern of squares but this is not the sole case of the invention and the pattern on the mask 108 may be so changed as to make ink guides having any desired shapes of tips. For example; the mask 108 may be provided with a linear pattern so that projections are formed in a single line as in the first embodiment and then etched in those areas which will not be used as ink guides, thereby fabricating ink guides having the tip shapes realized in the first embodiment.

Figure 10A:
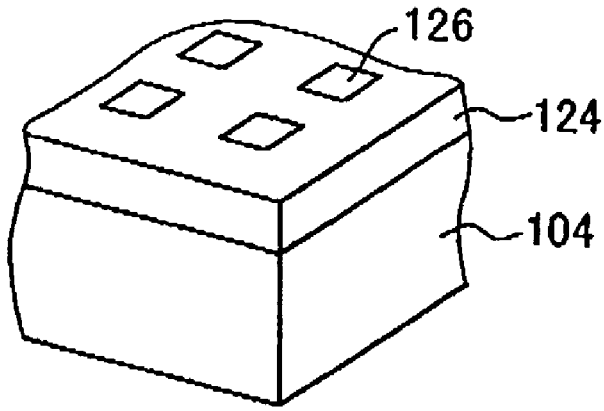
FIG. 10 is a schematic diagram illustrating a fourth embodiment of the process for producing the liquid ejecting head of the invention.
Figure 10B:
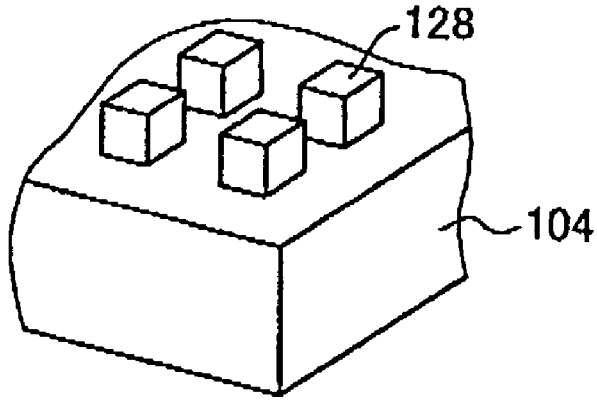
Figure 10C:
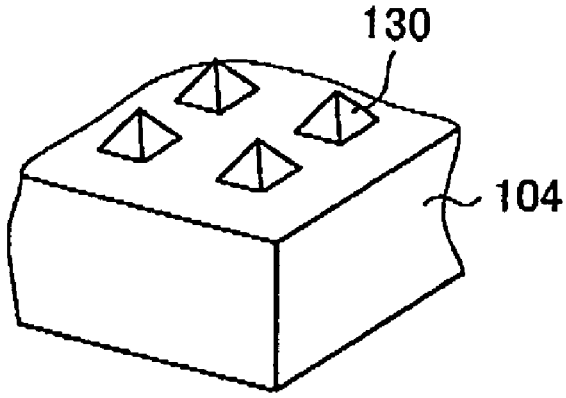

Referring to FIGS. 10A–10C, we then describe a fourth embodiment of the process for fabricating an ink-jet head which is an example of the liquid ejecting head of the invention. The fourth embodiment is essentially the same as the third embodiment except for the method of fabricating ink guides and the following description is primarily directed to this difference.

First, a glass substrate 104 (see FIG. 10A) which may be polished on both sides is provided. On top of this glass substrate, Si is joined by, for example, a surface activating technique to form a single-crystal substrate 124. The single-crystal substrate 124 is overlaid with a $SiO_2$ film by, for example, thermal oxidation. The $SiO_2$ layer is etched by photolithographic techniques in a pattern of squares whose sides extend in the (110) and (1–10) directions of the single-crystal substrate 124; this results in the fabrication of a mask 126 having a two-dimensional array of squares in positions corresponding to the ejecting portions.

Thereafter, dry etching is performed, typically using $SF_6$ gas, such that those areas of the single-crystal substrate 124 which are not covered with the mask 126 are removed by a predetermined amount; subsequently, dry etching is performed using $CF_4$ gas to remove the $SiO_2$ film, thereby forming prismatic structures 128 from the single-crystal substrate 124.

Thereafter, the assembly is immersed in a hot liquid such as a 34% aqueous KOH solution heated at about 70° C. and the prismatic structures 128 are etched anisotropically to fabricate projections 130 on top of the substrate 104 (see FIG. 10C). The projections 130 which serve as ink guides have sharp pointed peaks with an angle of no more than about 60 degrees (or a radius of curvature of no more than 4 micrometer).

The subsequent steps are the same as in the third embodiment except that the projections 130 are used in place of the projections 110.

In the fourth embodiment, the mask 126 used to form ink guides has a pattern of squares but this is not the sole case of the invention and the pattern on the mask 126 may be so changed as to make ink guides having any desired shapes of tips.

In either of the embodiments described above which relate to the method of fabricating an ink-jet head, a mask of the type shown in FIG. 7 may be used to form a partition wall that has slits formed in the sidewalls of its curved portions to serve as ink channel holes.

While the foregoing embodiments assume the fabrication of an ink-jet head having the structure shown in FIG. 1, an ink-jet head having the structure shown in FIG. 3 can also be fabricated by the same methods.

It should also be noted that the liquid ejecting head of the invention is by no means limited to the ejection of ink containing the particles of a colorant and that any electrostatic liquid ejecting heads will do if they eject a solution containing chargeable particles dispersed in a solvent, with the solution being not limited to any particular type.

Described above are the basics of the liquid ejecting head of the invention and the process for producing it.

While the liquid ejecting head of the invention and the process for producing it have been described above in detail, the invention is by no means limited to the foregoing embodiments and various improvements and modifications can of course be made without departing from the scope and spirit of the invention.

What is claimed is:

1. A liquid ejecting head which causes electrostatic force to act on a solution containing charged particles such that droplets of said solution are forced out through a two-dimensional array of ejecting portions, comprising:

a first insulating substrate having ejecting orifices opened in positions corresponding to the layout of said ejecting portions such that said solution is forced out through said ejecting orifices;

a second insulating substrate that is provided a specified distance from the first substrate so as to form a space between said first substrate and the second substrate which constitutes a flow channel for said solution;

electrodes for controlling the ejection of said solution which are provided on the surface of said first substrate which is remote from said second substrate in such positions that each electrode surrounds the periphery of the associated ejecting orifice;

a wall that is erected in said space to partition said flow channel in said space into an inflow region and an outflow region, said wall running in a serpentine path through said space to traverse said space in a direction perpendicular to the direction of the flow of said solution, and said wall passing by the positions of the ejecting orifices provided in said first substrate; and projecting solution guides that are erected on a ridge portion of said wall in positions corresponding to the positions of the ejecting orifices provided in said first substrate, said solution guides extending through said ejecting orifices to protrude from the surface of said first substrate which is remote from said second substrate; and wherein the solution flowing through said space passes through said ejecting orifices to be supplied to said solution guides.

2. The liquid ejecting head according to claim 1, wherein said ejecting portions are formed such that a plurality of them are aligned in a row along the flow of said solution and two or more of rows are arranged side by side to form a two-dimensional array, and said wall forms wall surfaces along the flow of said solution such that the wall passes through each row of said ejecting portions.

3. The liquid ejecting head according to claim 1, wherein a solution guide groove for guiding said solution from the inflow region of said space to the outflow region is formed on the ridge portion of said wall on both sides of each of said solution guides.

4. The liquid ejecting head according to claim 1, wherein the wall surface of each curved portion of said wall running in a serpentine path has a channel hole opened so that part of said solution is allowed to flow from the inflow region to the outflow region.

5. The liquid ejecting head according to claim 1, wherein said first substrate and the ridge portion of said wall are spaced apart by a specified distance.

6. A liquid ejecting head which causes electrostatic force to act on a solution containing charged particles such that droplets of said solution are forced out through a two-dimensional array of ejecting portions, comprising:

a first insulating substrate having ejecting orifices opened in positions corresponding to the layout of said ejecting portions such that said solution is forced out through said ejecting orifices;

a second insulating substrate that is provided a specified distance from the first substrate so as to form a space between said first substrate and the second substrate which constitutes a flow channel for said solution;

electrodes for controlling the ejection of said solution which are provided on the surface of said first substrate which is remote from said second substrate in such positions that each electrode surrounds the periphery of the associated ejecting orifice;

a plurality of walls that are erected in said space and which run in a serpentine path in a flow direction of said solution from an inflow region to an outflow region, each of said walls being so formed as to pass through the positions of the ejecting orifices provided in said first substrate; and projecting solution guides that are erected on a ridge portion of each of said walls in positions corresponding to the positions of the ejecting orifices provided in said first substrate, said solution guides extending through said ejecting orifices to protrude from the surface of said first substrate which is remote from said second substrate; and wherein the solution flowing through said space passes through said ejecting orifices to be supplied to the tips of said solution guides.

7. The liquid ejecting head according to claim 6, wherein said ejecting portions are formed such that a plurality of them are aligned in a row along the flow of said solution and two or more of rows are arranged side by side to form a two-dimensional array, and said solution guides are provided on the ridge portion of the curvature of each wall running in the serpentine path.

8. The liquid ejecting head according to claim 6, wherein a solution guide groove for guiding said solution from the inflow side of said space to the outflow side is formed on the ridge portion of each of said walls on both sides of each of said solution guides.

9. The liquid ejecting head according to claim 6, wherein said first substrate and the ridge portion of each of said walls are spaced apart by a specified distance.

* * * * *